United States Patent [19]

Kowalcyk

[11] Patent Number: 4,856,774

[45] Date of Patent: Aug. 15, 1989

[54] WEIGHT RELEASE

[76] Inventor: Robert A. Kowalcyk, 1073 W. Hannah St., Houtzdale, Pa. 16651

[21] Appl. No.: 206,748

[22] Filed: Jun. 15, 1988

[51] Int. Cl.[4] ..... A63B 13/00

[52] U.S. Cl. ..... 272/123; 248/340

[58] Field of Search ..... 272/93, 117, 119, 122, 272/123, 143; 248/340, 364

[56] References Cited

U.S. PATENT DOCUMENTS

| | | | |
|---|---|---|---|
| 4,205,838 | 6/1980 | McIntosh | 272/123 |
| 4,360,198 | 11/1982 | Waulters | 272/117 |
| 4,666,150 | 5/1987 | Segrist et al. | 272/123 |
| 4,676,465 | 6/1987 | Myotte | 248/340 X |
| 4,757,998 | 7/1988 | Landin | 272/123 |
| 4,773,642 | 9/1988 | Cruz | 272/123 |

FOREIGN PATENT DOCUMENTS

| | | | |
|---|---|---|---|
| 1330826 | 5/1963 | France | 248/340 |

*Primary Examiner*—Richard J. Apley
*Assistant Examiner*—Robert W. Bahr

[57] ABSTRACT

A device comprised of a hook, threaded bar and angled base can be loaded with weight plates and attached by the hooks to each end of a barbell. The height of the hook can be adjusted so that the device detaches from the barbell at the low point of the barbell desired by the lifter.

5 Claims, 2 Drawing Sheets

WEIGHT RELEASE

BACKGROUND OF THE INVENTION

The invention can be used in many exercises, but the bench press is the exercise best suited to its uniqueness. Many body builders and power lifters do what are called "negative reps" to gain muscle size and strength. Unfortunately this requires a lifting partner to lift the heavy weight off the lifter's chest. The present weight release enables a lifter to perform heavy negatives by himself.

The bench press is an exercise that usually dictates a spotter be present. When a lifter fails to complete a lift the spotter assists him. The present weight release eliminates the need for a spotter during this exercise.

SUMMARY OF THE INVENTION

It is an object of the present invention to enable one to lower a weight heavier than he can lift, and yet to finish the lift unassisted by a spotter.

It is another object of the present invention to provide a means to safely reduce the amount of weight being lifted for repetitions, in the case of muscular fatigue or any other reason causing one to be unable to push the weight bar to one's arm length.

Another object of the invention is to provide an adjustable device which can be used by lifters of all sizes.

It is another object of the invention to enable quick loading and unloading on the device when using Olympic style plates.

DESCRIPTION OF THE PREFERRED EMBODIMENT

Figure 1:
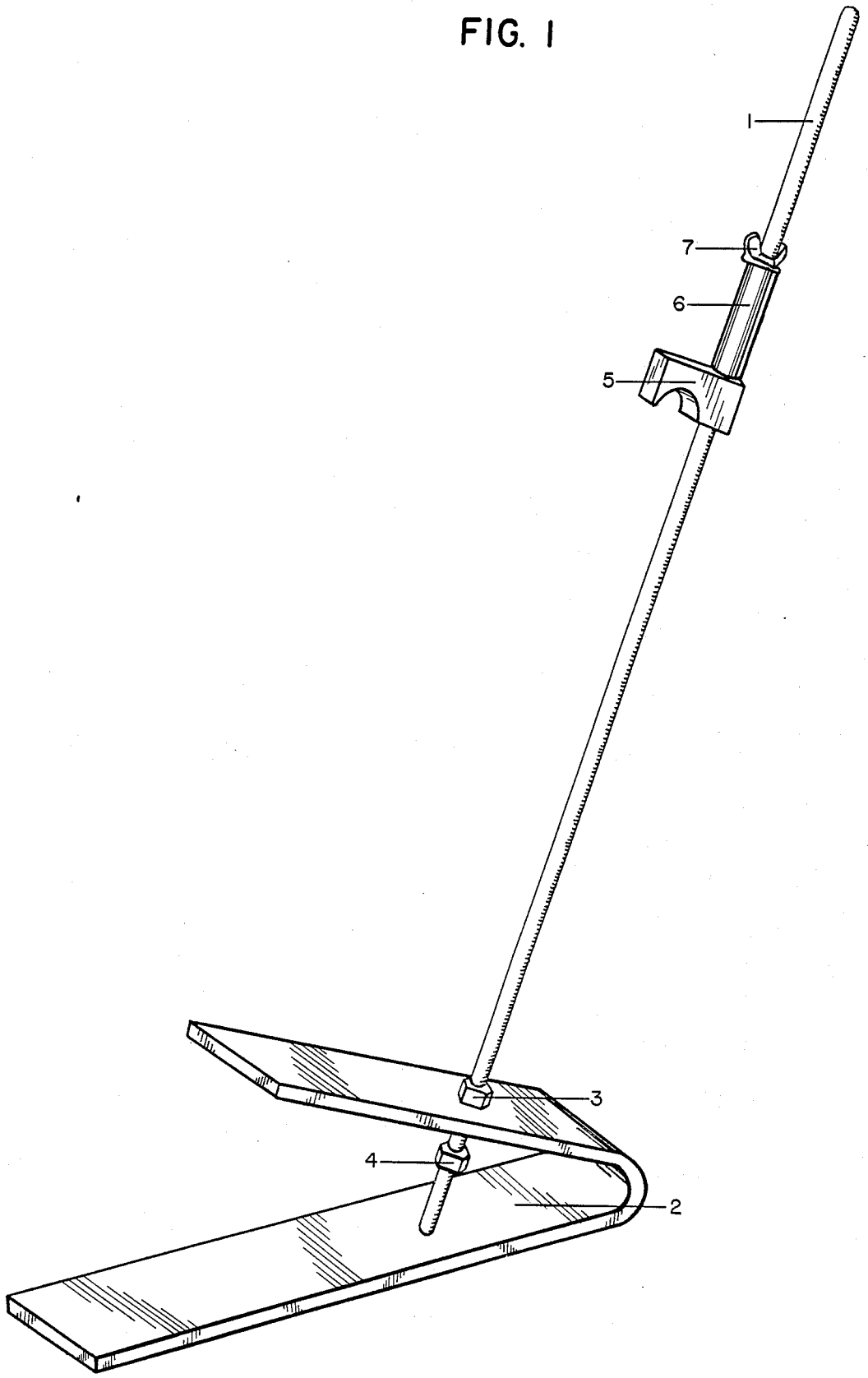
FIG. 1 is a perspective view of the invention.

Referring to FIG. 1 of the drawings, the invention comprises a threaded bar 1 which may, for example, be 36" in length and ½" in diameter. The bar 1 is connected to a base 2 which comprises a bent piece of steel which may, for example, have dimensions of 17½"×13"×⅛". The base is preferably bent at an angle of approximately 40° to form a lower floor engaging portion and an upper weight receiving portion. The floor engaging portion is preferably 1½" longer than the weight receiving portion.

The threaded bar 1 is secured to the base 2 by nuts 3, 4. Positioned at the correct height on the bar 1 (depending on the lifter's arm length, chest thickness and bench height) is a hook 5 which may, for example, be formed of a threaded 1"×2"×¾" piece of steel having 1⅝" radius notch in its lower edge. Above the hook 5 is a spacer 6, which is preferably 1½" long with a ½" internal diameter. The spacer 6 makes it easier to load the invention onto a barbell. Holding the spacer 6 and securing the hook 5 is a wingnut 7.

Figure 2:
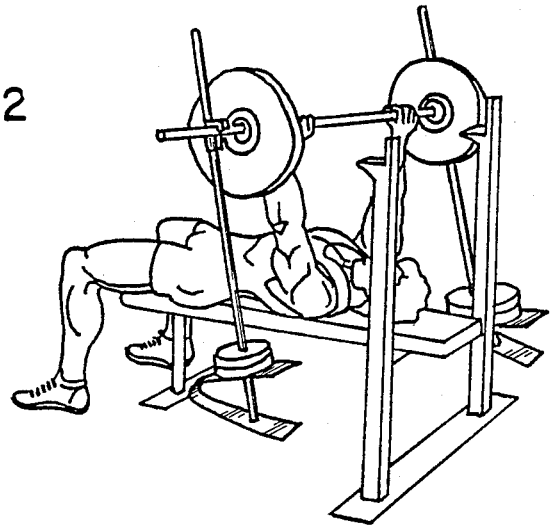
FIGS. 2, 3 and 4 are views of the invention during use.
Figure 3:
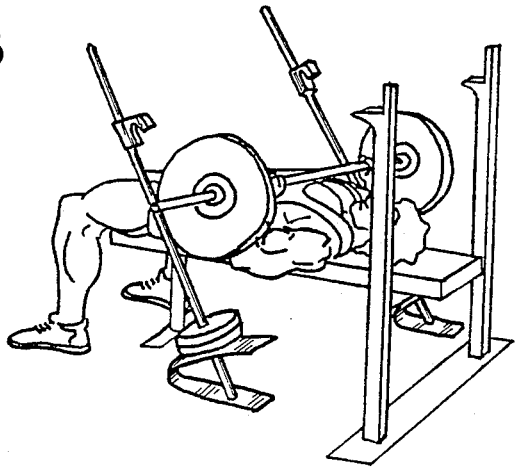
Figure 4:
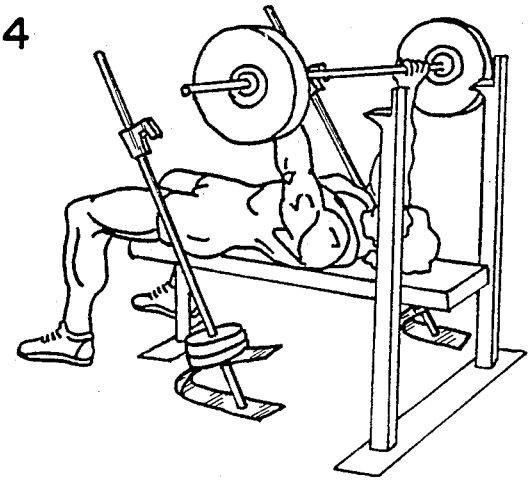

The use of the invention is illustrated in FIGS. 2–4 of the drawings. FIG. 2 shows a pair of weight releases attached by means of their hooks 5 to the opposite ends of a barbell outside of the weight collars. The lifter attaches the weight releases to the bar prior to removal of the bar from the rack, and in FIG. 2, has just removed the bar from the rack with the weight releases attached. It should be noted that if the bar were an Olympic bar, the weight releases would be attached to the bar inside of the weight plates. The releases are shown on the outside of the bar weights of the drawings in order to make them more visible and thus more clearly illustrate their function.

FIG. 3 shows the lifter after he has lowered the barbell from the raised position of FIG. 2. The hook 5 of each weight release has been adjusted for the lifter so that the instant the barbell touches his chest the base 2 of each release touches the floor. Because of the angle of the floor engaging portion of the base 2 in relation to the threaded bar 1, the hook 5 of each weight release is freed from the barbell.

FIG. 4 shows the detached weight releases standing on both sides of the lifter and the lifter pushing the lightened barbell from his chest to arm's length prior to return to the rack.

For a different type exercise, the weight releases can be adjusted by moving the hook 5 on the threaded bar 1 to a position such that the base 2 does not touch the floor when the barbell is touching the lifter's chest. When so adjusted, the lifter can do weight lowering and raising repetitions with the weight releases attached. If the lifter is unable to continue due to fatigue or other reason and cannot return the barbell to the rack, all he has to do as the barbell lies on his chest is let one side of the bar slant down so that the base 2 of the weight release on that side touches the floor, releasing its hook. After the weight release comes off the one side, he merely does this same simple movement for the other side to release the second weight release. The lifter now pushes only the barbell to arm's length and returns it to the rack.

Changes in details of construction can be effected by those skilled in the art without departing from the invention.

I claim:

1. A weight lifting aid for use with a barbell comprising:

a base, said base having a floor engaging surface and a weight receiving portion for receiving and retaining exercise weight plates, a bar mounted on and extending upwardly from said base at an angle to said floor engaging surface, a hook adjustably mounted on said bar facing the base, said hook permitting attachment of the device and retained weight plates to a barbell for use in barbell lowering exercise, said angle between said bar and said base floor engaging portion being sufficient to effect movement of the bar away from the barbell upon release of the hook from the barbell when the floor engaging surface is seated on the floor.

2. A weight lifting aid as claimed in claim 1, wherein said bar extends upwardly from said weight receiving portion of said base.

3. A weight lifting aid for use with a barbell comprising:

a base, the base having a floor engaging portion and a weight receiving portion for receiving and retaining exercise weight plates, the floor engaging portion and the weight receiving portion forming an acute angle;

a bar mounted on and extending generally perpendicularly from the weight receiving portion of the base; and a hook adjustably mounted on the bar facing the base, where the device may be attached to a barbell by the hook for use in exercise, and be released from the barbell when the base touches the floor.

4. A weight lifting aid as claimed in claim 3, wherein said acute angle is approximately 40°.

5. A weight lifting aid as claimed in claim 3, wherein said base comprises a V-shaped element, one leg of which element comprises said floor engaging portion and the other leg of which element comprises said weight receiving portion.

* * * * *